United States Patent [19]

Kühn

[11] Patent Number: 4,612,065

[45] Date of Patent: Sep. 16, 1986

[54] METHOD FOR THE HEAT TREATMENT OF WORKPIECES

[75] Inventor: Friedhelm Kühn, Mülheim, Fed. Rep. of Germany

[73] Assignee: Ruhrgas Aktiengesellschaft, Essen, Fed. Rep. of Germany

[21] Appl. No.: 744,656

[22] Filed: Jun. 14, 1985

Related U.S. Application Data

[63] Continuation of Ser. No. 521,846, Aug. 10, 1983, abandoned.

[30] Foreign Application Priority Data

Aug. 17, 1982 [DE] Fed. Rep. of Germany ..... 3230531

[51] Int. Cl.[4] ..... C21D 1/18

[52] U.S. Cl. ..... 148/16; 148/20.3

[58] Field of Search ..... 148/16.1, 6.5, 16.6, 148/16.7, 20.3, 13.1, 13; 432/15, 28; 34/10, 57 R, 57 A, 57 B

[56] References Cited

U.S. PATENT DOCUMENTS

| | | | |
|---|---|---|---|
| 2,719,112 | 9/1955 | Kearby et al. | 34/10 |
| 2,813,351 | 11/1957 | Godel | 34/10 |
| 3,053,704 | 9/1962 | Munday | 148/16.6 |
| 3,197,328 | 7/1965 | Jung et al. | 148/20.3 |
| 3,259,998 | 7/1966 | LeClere et al. | 34/10 |
| 4,410,373 | 10/1983 | Kemp | 148/16 |

FOREIGN PATENT DOCUMENTS

| | | | |
|---|---|---|---|
| 2455280 | 5/1976 | Fed. Rep. of Germany | 148/13.1 |
| 2440994 | 7/1980 | France | 266/252 |
| 2448573 | 10/1980 | France | 266/252 |

*Primary Examiner*—Christopher W. Brody

[57] ABSTRACT

A method is described for the heat treatment, preferably for the intermediate heat treatment, of workpieces, in which the workpieces coming from a heating apparatus are quenched in a fluidized bed under precise temperature and movement control, and then, if necessary, transferred to a structure transformation apparatus.

16 Claims, No Drawings

METHOD FOR THE HEAT TREATMENT OF WORKPIECES

This application is a continuation, of application Ser. No. 521,846, filed Aug. 10, 1983 now abandoned.

The invention relates to a method for the heat treatment of workpieces, in which workpieces coming from a heating apparatus are quenched.

The workpieces are often quenched in an oil bath or salt bath, and then it is necessary after removing them from the bath to clean them. A considerable amount of work is required for this purpose. Furthermore, oily or salty waste water is produced which is a burden on the environment and some of it has to be delivered to disposal sites.

If a salt bath is used, additional safety measures are also necessary.

Furthermore, the losses incurred when the workpieces are unloaded from the baths are also a source of considerable additional cost, whether oil or salt is used.

The object of the invention is therefore to devise a method of heat treatment which will operate in a substantially less environmentally harmful manner, while involving a reduction in labor and energy costs.

For the attainment of this object, the method of the invention is characterized by the fact that the workpieces are placed for quenching in a fluidized bed, which is produced by at least one gas stream directed in one chief direction of flow, using for the production of the bed a medium which has a higher thermal conductivity than the material of the workpieces being quenched, by the fact that the workpieces are moved, as they are quenched, relative to the gas stream producing the fluidized bed, while individual, pulsed gas jets are injected into the fluidized bed substantially at right angles to the main direction of flow of the gas stream, and by the fact that during the time of treatment of the workpieces the fluidized bed is maintained at substantially constant temperature.

The gas stream guided in the main direction of flow consists in practice usually of a plurality of substantially parallel partial streams, which together produce the fluidized bed.

After their removal from the fluidized bed the workpieces do not require any kind of cleaning. Thus the disadvantages described above as regards energy consumption and environmental pollution are eliminated. Also, the unloading losses from the fluidized bed are minimal.

The operating parameters of the fluidized bed are selected in accordance with the invention such that quenching conditions are produced which even permit treatment of relatively large workpieces having complex surfaces. The maintenance of a constant temperature assures that unchanging thermal gradient conditions prevail, a sufficiently steep thermal gradient being favored by the fact that the thermal conductivity of the fluidized bed medium is greater than that of the material that is to be quenched.

The fluidized bed medium consists preferably of particles of a metallic or nonmetallic-inorganic nature; examples are aluminum alloys or carbides, provided they have a greater thermal conductivity than the, as a rule, metallic material of the workpieces being treated.

The invention provides such that, even in the "downwind zones" a constant exchange of particles takes place, not only due to the pulse-like individual jets, but also due to the movement of the workpieces. This movement can be vibrations or long strokes. The direction of movement is not critical, yet if the movements are in the direction of flow, they must be faster than the gas stream.

The method of the invention is especially well suited for the intermediate heat treatment of workpieces. Heretofore it has been necessary, particularly when oil baths are used, to apply special care to the cleaning of the workpieces, since otherwise there was the danger that oil residues might vaporize or burn in the following holding furnace in which the structure transformation takes place, and result in the uncontrollable emission of pollutants. This danger does not exist in the invention.

In accordance with the invention, the workpieces coming from the heating apparatus for intermediate heat treatment are first quenched in the fluidized bed, and then transferred in a known manner to a structure transformation apparatus. When this method is applied to the intermediate heat treatment of workpieces made of gray casting alloys, the workpieces can be brought, for example, to the following temperatures:

to about 900° C. in the heating apparatus, to about 350° C. (temperature in the marginal zones of the workpieces) by the quench in the fluidized bed, and to about 400° C. (desired holding temperature) in the structure transformation apparatus.

The quenching conditions in the fluidized bed can be adapted in an optimum manner to the treatment that follows in the structure transformation apparatus.

Under certain circumstances it may be advantageous to add moisture, preferably as steam, together with the gas stream to the fluidized bed. This makes it possible to establish a higher heat-transfer coefficient. If necessary, the time of stay of the workpieces in the fluidized bed can be shortened in this manner. The addition of moisture in the form of steam assures that no lumps will form in the fluidized-bed medium.

Preferably the fluidized bed medium has a constant radiation number over a wide temperature range, for example of about 600° C. A rapid temperature equalization within the fluidized bed is assured in this manner.

According to another advantageous feature, a gas is used to produce the fluidized bed, which has the same electrical charge sign as the particles of the fluidized bed medium. In this manner, electrostatic charges are avoided, which under certain circumstances can cause the fluidized bed particles to adhere to one another.

According to the invention, the possibility furthermore exists of regenerating the fluidized bed medium during the loading and unloading of the workpieces. In this manner the particle size of the fluidized bed medium can be kept constant, and, if necessary, the particles can also be cooled. Since the regeneration takes place during the loading and unloading of the fluidized bed, interference with the quenching process is avoided.

In the case of intermediate heat treatment, the workpieces are preferably cooled below the anticipated holding temperature only to the degree that the holding temperature will be reached after removal from the fluidized bed by the flow of heat from the core to the peripheral zones of the workpieces. In the structure transformation apparatus that follows, therefore, no delivery of heat to the workpieces is necessary. This used to be unavoidable in the known bath cooling, because in that case precise control was impossible on account of the steep temperature gradients, and therefore it was necessary as a precaution to quench the workpieces more intensely.

An especially desirable utilization of energy results when the method of the invention is applied to intermediate heat treatment, due to the fact that the heat leaving the fluidized bed with the gas stream is used for heating the structure transformation apparatus.

To see to it that the quenching conditions are always alike, it is advantageous to regulate the time it takes to transport the workpieces from the heating apparatus to the fluidized bed according to the radiation characteristics of the workpieces. The greater the radiation is, the shorter is to be the transport time. The workpieces then enter the fluidized bed always with the same temperature. It is also possible to control the temperature differences within a batch and between individual sections of workpieces.

The method of the invention can be discontinuous, that is, it can be practiced batch-wise, or it can be continuous, for example in pass-through operation.

It is accordingly intended that the foregoing disclosure be considered only as an example of the principles of the present invention. The scope of the invention is determined by the appended claims.

I claim:

1. A method for the heat treatment of workpieces, comprising the steps of:

heating the workpieces in a heating apparatus to an elevated temperature, unloading the workpieces from the heating apparatus for further treatment, and cooling the workpieces unloaded from the heating apparatus to a temperature decidedly lower than the elevated temperature, said cooling step including:

placing the workpieces for cooling into a fluidized bed which is produced by at least one gas stream guided in a main flow direction, the fluidized bed comprising a medium of particles which have a higher thermal conductivity than the material of the workpieces being cooled, thereby providing a steep thermal gradient, producing a turbulent, mixing motion of the particles in the bed adjacent to the workpiece whereby substantially all surfaces of the workpieces, including a downwind facing surface thereof, are contacted by bed particles which are undergoing a moving, mixing motion, said step of providing turbulent, mixing motion including:

moving the workpieces during cooling relative to the gas stream producing the fluidized bed, while in addition to said relative movement injecting a plurality of individual, pulsed gas jets into the fluidized bed at substantially right angles to the main direction of flow of the gas steam and directed toward the workpieces, said moving and injecting steps providing a continuous exchange of particles of said medium at all surfaces of the workpieces during cooling, and holding the fluidized bed at a substantially constant temperature during cooling of the workpieces in the fluidized bed.

2. A method in accordance with claim 1, in which the workpieces pieces unloaded from the heating installation for intermediate heat treatment are first cooled in the fluidized bed and then transferred to a structure transformation apparatus.

3. A method in accordance with claim 1, in which moisture, preferably as steam, is added to the fluidized bed with the gas stream.

4. A method of claim 1, in which the fluidized bed medium has a constant radiation number over a wide temperature range.

5. A method of claim 1, in which the gas in the fluidized bed has the same electrical charge sign as the particles of the fluidized bed medium.

6. A method of claim 1, in which the fluidized bed medium is regenerated during the workpiece loading time.

7. A method of claim 2, in which the workpieces are cooled with regard to the desired holding temperature only to such an extent that their holding temperature after removal from the fluidized bed is achieved by heat flow from a core zone to peripheral zones of the workpieces.

8. a method of claim 2, in which the heat leaving the fluidized bed with the gas stream is used for heating the structure transformation apparatus.

9. A method of claim 1, in which the time during which the workpieces are transported from the heating apparatus to the fluidized bed is controlled in accordance with the radiation behavior of the workpieces.

10. A method for the intermediate heat treatment of workpieces, comprising the steps of:

heating the workpieces in a heating apparatus to a relatively high temperature, removing the workpieces from the heating appatatus for further treatment, quenching the workpieces removed from the heating apparatus by cooling to a temperature considerably lower than said relatively high temperature, said quenching step including:

placing the workpieces for cooling into a fluidized bed which is produced by at least one gas stream directed in a main direction of flow, the fluidized bed comprising a medium of particles which have a higher thermal conductivity than the material of the workpieces being quenched, thereby providing a steep thermal gradient, providing a turbulent, mixing motion of the particles in the bed adjacent to the workpiece whereby substantially all surfaces of the workpiece, including the downstream facing surfaces thereof, are contacted by bed particles which are undergoing moving, mixing motion, said step including moving the workpieces during quenching relative to the gas stream while in addition to said relative movement injecting a plurality of individual pulsed gas jets into the fluidized bed substantially at right angles to the main direction of flow of the gas stream substantially toward the workpieces, said moving and injecting steps providing a continuous exchange of particles of said medium at all surfaces of the workpieces during quenching, keeping the fluidized bed at substantially constant temperature during quenching of the wokrpieces in the fluidized bed, transferring the workpieces to a structure transformation apparatus, and treating the workpieces in the latter until structure transformation is achieved.

11. A method of claim 10, in which the workpieces are quenched with regard to the desired holding temperature only to such an extent that their holding temperature is reached after removal from the fluidized bed, by flow of heat from a core zone to peripheral zones of the workpieces.

12. A method of claim 10, in which the heat leaving the fluidized bed with the gas stream is used for heating the structural transformation apparatus.

13. A method of claim 10, in which moisture, preferably as steam, is added to the fluidized bed with the gas stream.

14. A method of claim 10, in which the fluidized bed medium has a constant radiation number over a wide temperature range.

15. A method of claim 10, in which the gas in the fluidized bed has the same electrical charge sign as the particles of the fluidized bed medium.

16. A method of claim 10, in which the duration of transport of the workpieces from the heating apparatus to the fluidized bed is controlled in accordance with the radiation behavior of the workpieces.

* * * * *